United States Patent [19]

Epperson, Jr.

[11] 4,431,150

[45] Feb. 14, 1984

[54] GYROSCOPICALLY STEERABLE BULLET

[75] Inventor: Edwin H. Epperson, Jr., Ontario, Calif.

[73] Assignee: General Dynamics, Pomona Division, Pomona, Calif.

[21] Appl. No.: 371,044

[22] Filed: Apr. 23, 1982

[51] Int. Cl.[3] ..... F41G 7/00

[52] U.S. Cl. ..... 244/3.21; 244/3.1

[58] Field of Search ..... 244/3.2, 3.21, 3.23, 244/3.1, 3.11, 3.14, 3.15, 3.16, 3.19

[56] References Cited

U.S. PATENT DOCUMENTS

| | | | |
|---|---|---|---|
| 976,732 | 11/1910 | Gherassimoff . | |
| 1,181,136 | 5/1916 | Hayden . | |
| 1,316,033 | 9/1919 | Hayden . | |
| 1,316,363 | 9/1919 | Hayden | 244/3.1 |
| 1,459,198 | 6/1923 | Dunajeff . | |
| 2,402,718 | 6/1946 | Albree . | |
| 3,060,425 | 10/1962 | Cutler . | |
| 3,067,681 | 12/1962 | Beman . | |
| 3,067,682 | 12/1962 | Feldmann et al. . | |
| 3,493,194 | 2/1970 | Kurzhals . | |
| 3,647,162 | 3/1972 | Muller | 244/3.2 |
| 3,813,067 | 5/1974 | Mork | 244/3.22 |
| 3,913,870 | 10/1975 | Bolick | 244/3.2 |
| 3,982,714 | 9/1976 | Kuhn | 244/3.16 |
| 4,009,848 | 3/1977 | Albert et al. | 244/3.16 |
| 4,093,154 | 6/1978 | McLean | 244/3.16 |
| 4,116,404 | 9/1978 | Howell | 244/3.23 |
| 4,291,849 | 9/1981 | Rodgers et al. | 244/3.22 |
| 4,389,028 | 6/1983 | Kalivretenos et al. | 244/3.1 |

*Primary Examiner*—Charles T. Jordan

*Attorney, Agent, or Firm*—Neil F. Martin; Michael H. Jester; Edward B. Johnson

[57] ABSTRACT

A projectile body has a gyro mounted therein including a rotor and a mechanism for supporting the rotor for rotation about a spin axis initially coincident with the longitudinal axis of the projectile body and pivotable away from the longitudinal axis of the projectile body. The rotor is initially locked to the projectile body so that it is spun with the projectile body during launch. Thereafter, the rotor is unlocked and the projectile body is de-spun to a relatively slow rate of rotation while transferring angular momentum to the free spinning rotor which continues to rotate at a high rate relative to the projectile body. Rotationally phased steering commands, which are generated from on-board homing sensor signals or up-link data signals received from a remote error sensor, are applied to a linear actuator within the projectile body. The actuator pivots the spin axis of the rotor away from the longitudinal axis of the projectile body. The resulting precession torque of the spinning rotor induces a change in the angle of attack between the projectile body axis and the actual velocity vector of the projectile thereby inducing midcourse trajectory shaping.

11 Claims, 12 Drawing Figures

GYROSCOPICALLY STEERABLE BULLET

BACKGROUND OF THE INVENTION

The present invention relates to artillery and firearms, and more particularly, to a gyroscopically steerable bullet.

Many self-propelled missiles have been developed which have on-board homing sensors or remote guidance capability. Such missiles are capable of midcourse trajectory shaping. Therefore, the accuracy of such missiles in hitting their targets is much greater than if they were simply aimed and fired, without any in-flight guidance.

Conventional bullets, such as 5-inch, 8-inch, 105 mm, and 152 mm artillery projectiles are not guided during flight. In some instances, the barrels from which conventional bullets are fired may be aimed by radar equipped tracking devices. Conventional bullets are frequently spun when launched to provide stability during flight and thereby improve accuracy.

It would be desirable to improve the accuracy of bullets by providing the capability for midcourse trajectory shaping. Preferably such steerable bullets would be relatively inexpensive and would retain a high degree of reliability.

SUMMARY OF THE INVENTION

Accordingly, it is the primary object of the present invention to improve the accuracy of conventional bullets.

Another object of the present invention is to supplement the spin stabilization of bullets which has heretofore conventionally been provided by projectile spin.

Accordingly, the present invention provides a projectile body having a gyro mounted therein including a rotor and a mechanism for supporting the rotor for rotation about a spin axis initially coincident with the longitudinal axis of the projectile body and pivotable away from the longitudinal axis of the projectile body. The rotor is initially locked to the projectile body so that it is spun with the projectile body during launch. Thereafter, the rotor is unlocked and the projectile body is de-spun to a relatively slow rate of rotation while transferring angular momentum to the free spinning rotor which continues to rotate at a high rate relative to the projectile body. Steering commands, which are generated from on-board homing sensor signals or up-link data signals received from a remote error sensor, are applied to a linear actuator within the projectile body. The actuator pivots the spin axis of the rotor away from the longitudinal axis of the projectile body. The resulting precession torque of the spinning rotor induces a change in the angle of attack between the projectile body axis and the actual velocity vector of the projectile thereby inducing midcourse trajectory shaping. The phase of the steering commands is varied through 360 degrees at the same rate of rotation as the projectile body.

In a second embodiment of the invention, the projectile body is not spun during launch and the rotor is spun up by means of an internal jet. Thereafter, the spin axis of the rotor is pivoted in two orthogonal control planes to effect midcourse trajectory shaping.

DESCRIPTION OF THE PREFERRED EMBODIMENT

Figure 1:
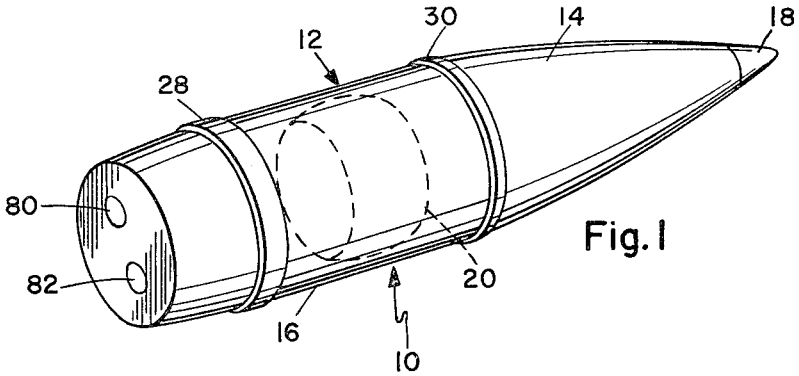
FIG. 1 is a perspective view of a first embodiment of my steerable bullet, illustrating its internal gyro rotor in phantom lines.

Referring to FIG. 1, a first embodiment 10 of the steerable bullet of the present invention includes a projectile body 12 having a tapered nose portion 14 and a generally cylindrical rear portion 16. The nose portion of the projectile body is filled with high explosive which is detonated upon impact by a fuse 18 which forms the tip of the nose portion. A cylindrical casing (not shown) containing a soild propellant may be coupled to the rear portion 16 of the projectile body. When the projectile body and attached casing are loaded within a suitable barrel, the propellant within the casing may be ignited. The exploding propellant causes the projectile body to separate from the casing so that the projectile body is launched from the barrel under tremendous initial acceleration and velocity. The projectile could also be assisted during flight with further propulsive means not shown.

The steerable bullet includes a gyro mounted within the projectile body. The gyro includes a rotor 20 shown in phantom lines in FIG. 1. The spin axis 21 (FIG. 3) of the rotor is initially coincident or aligned with the central, longitudinal axis 22 (FIG. 2) of the projectile body.

Figure 2:
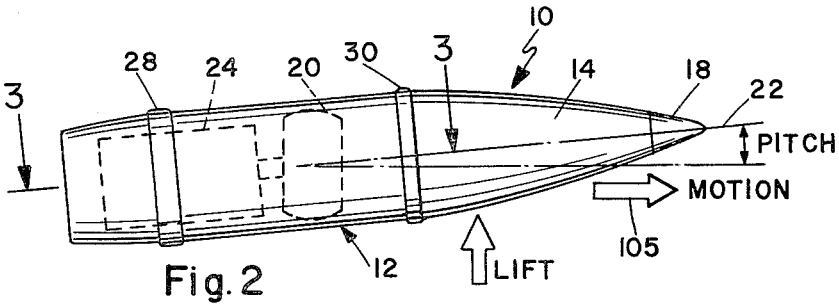
FIG. 2 is a side elevation view of the steerable bullet of FIG. 1 illustrating the manner in which midcourse trajectory shaping may be achieved by pivoting the spin axis of the rotor relative to the projectile body axis.

A mechanism 24 shown in phantom lines in FIG. 2 is provided for pivoting the rotor spin axis 21 away from the projectile axis 22 during flight to accomplish mid-course trajectory shaping or "steering". A pair of longitudinally spaced rifling bands 28 and 30 (FIG. 1) project externally from the circumference of the projectile body. These bands engage helical rifling on the inner surface of the barrel from which the bullet is discharged or launched. The interaction between the rifling bands and the barrel rifling imparts an initial spin or rotation to the bullet about the longitudinal axis 22 of the projectile body.

Figure 3:
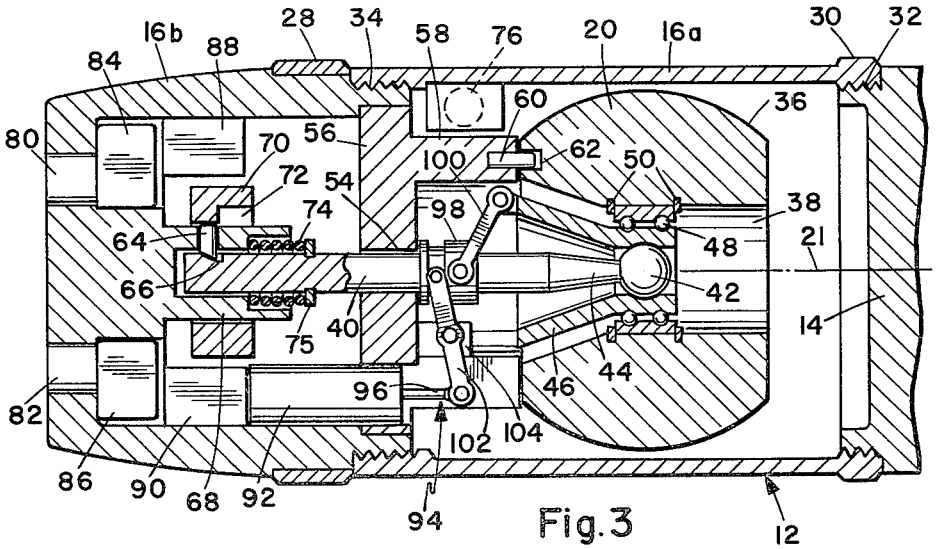
FIG. 3 is an enlarged, fragmentary sectional view of the first embodiment of the bullet taken along line 3—3 of FIG. 2. In this view, the gyro rotor is in its locked position.

As shown in FIG. 3, the rear portion of the projectile body 12 includes a hollow, cylindrical gyro housing 16*a*. This housing has internal threads at its forward end which are screwed over external threads at the rearward end of the tapered nose portion 14 to define a threaded joint 32 therebetween. The rear portion of the projectile body further includes a hollow, cylindrical end cap portion 16*b*. The forward end of this end cap portion has external threads which are screwed into internal threads at the rearward end of the gyro housing 16*a* to define a threaded joint 34. The end cap 16*b* is slightly tapered rearwardly.

A free gyro is mounted within the interiors of the housing 16*a* and end cap 16*b* of the steerable bullet. This gyro includes the rotor 20 and a means for supporting the rotor for rotation about its spin axis 21 which is pivotable away from the projectile axis 22. The rotor 20 preferably is a relatively heavy, solid mass having a round outer surface 36 and a large hole 38 extending centrally therethrough.

The pivotal supporting means of the gyro includes a post 40 (FIG. 3) which extends through the hollow interiors of the housing 16*a* and end cap 16*b*, concentric with the longitudinal axis 22 of the projectile body. The forward end of the post 40 has a ball portion 42 connected to a tapered portion 44. The narrow end of a generally conical shaped tiltable yoke 46 is seated about the ball portion 42 of the post and can be pivoted in any direction, thirty degrees relative to the axis of the post. The yoke extends through the central hole 38 in the rotor 20. A ring-type ball bearing assembly 48 rotatably mounts the rotor to the narrow end of the yoke. A pair of removable snap rings 50 seat in annular grooves formed in the interior wall of the rotor 20 and clamp the bearing assembly 48 therebetween.

The rearward end of the post 40 (FIG. 3) is slidably received in a socket 52 (FIG. 4) formed in the end cap 16*b*. The intermediate portion of the post 40 slides within a hole 54 (FIG. 3) formed in a dividing member 56 secured in the forward end of the end cap 16*b*.

The first embodiment 10 of my steerable bullet is provided with a means for spinning up the rotor 20. This may be done by providing a means for transferring the angular momentum from the projectile body to the rotor. The projectile body may then be de-spun by means hereafter described so that the rotor 20 is spinning at a high rate relative to the projectile body. In order to accomplish this, the bullet 10 may be provided with a means for locking the rotor to the projectile body with the spin axis of the rotor and the projectile axis coincident. The rotor will then be spun when the projectile body is spun about its axis during launch. The bullet 10 may also be provided with means for unlocking the rotor after the projectile body and rotor have been spun during launch so that the rotor can spin freely. The bullet is further provided with means for de-spinning the projectile body relative to the rotor.

In order to accomplish the foregoing translation of angular momentum of the projectile body to the rotor of the gyro, the rotor 20 is initially held against a raised portion 58 (FIG. 4) of the dividing member 56. The outer ends of pins such as 60 (FIG. 3) whose lower ends are fixed in the raised portion 58 seat such as within aligned recesses such as 62 formed in the bottom of the rotor to hold the rotor in position during launch.

Prior to launch of the bullet, the post 40 is in its retracted position illustrated in FIG. 3. In this position, the tapered end of a pin 64 projects into the socket 52 and engages a recess 66 in the base of the post to hold the same in position. The pin 64 is slidable within a recess in a central cylindrical portion 68 of the end cap 16*b*. The pin 64 is upwardly biased by a spring mechanism not shown. The pin 64 is held in its locking position prior to launch by a sleeve 70.

Figure 4:
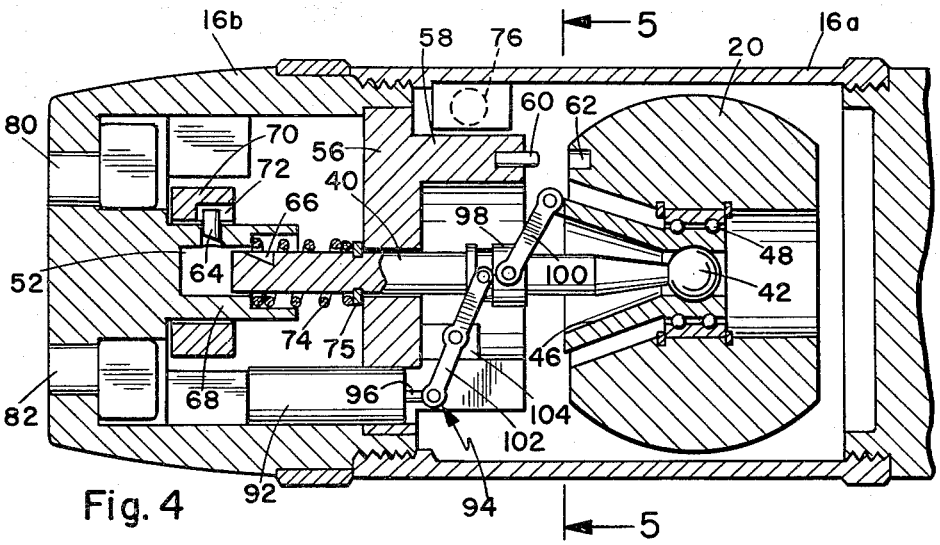
FIG. 4 is a sectional view similar to that of FIG. 3 showing the gyro rotor in its unlocked position.

When the bullet is launched, acceleration causes the sleeve 70 to slide rearwardly over the cylindrical portion 68 to the position illustrated in FIG. 4. In this position, the sleeve 70 has a recess 72 aligned with the pin 64 so that the spring biased pin 64 can move upwardly. This permits the post 40 to move forwardly to its extended position shown in FIG. 4 as a result of the force of the spring 74 compressed between the cylindrical portion 68 and the rear side of the dividing member 56. The spring is held between a stop 75 and the cylindrical portion 68 of the end cap 16*b*.

Figure 5:
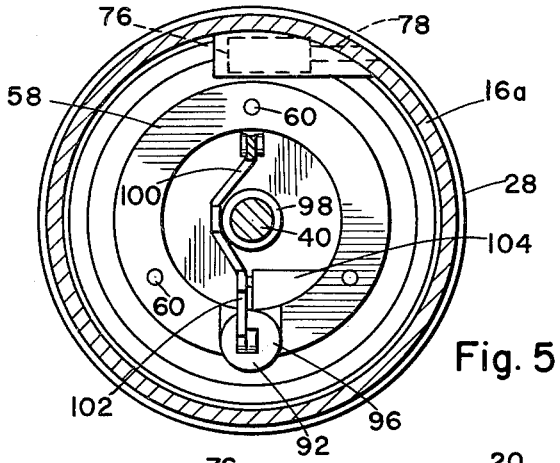
FIG. 5 is a sectional view of the first embodiment of the bullet taken alone line 5—5 of FIG. 4.

When the post 40 has moved to its extended position illustrated in FIG. 4, the rotor 20 is moved clear of the raised portion 58 of the dividing member 56. The pins 60 are thus disengaged from the recesses 62 in the rotor and the rotor is free to spin. At this point both the projectile body 12 and the rotor 20 are spinning together. Thereafter, the projectile body is de-spun so that the rotor 20 remains spinning at a high speed relative to the projectile body. Means for de-spinning the projectile body relative to the rotor may comprise a jet or de-spin charge 76 mounted within the projectile body for generating an external thrust substantially perpendicular to the projectile axis through an outwardly opening, tangential exhaust port 78 (FIG. 5). An alternative de-spinning means may comprise a plurality of fins (not shown) mounted within the projectile body and means for temporarily extending the fins externally of the projectile body after the bullet has been spun during launch and the rotor has been unlocked.

Clearly, whatever method is utilized, the rotor must spin at a high enough speed relative to the projectile body to generate gyroscopic precession torques which are sufficiently great so that the velocity vector of the projectile body can be modified during flight by pivoting the spin axis of the rotor. By way of example, a rotor spin rate of two thousand revolutions per second may suffice. It should be pointed out that with regard to the first embodiment 10 of my gyroscopically steerable bullet, the projectile body is de-spun so that it is still rotating a slight amount, for example between zero and ten revolutions per second. As will become more apparent hereafter, this is important since it enables the bullet to be steered through a mechanism which is only capable of pivoting the spin axis of the rotor in a single plane when the bullet is stationary. Proper phasing of steering commands relative to the rotational position of the projectile body is required in order to achieve the desired direction of velocity vector change.

Figure 10:
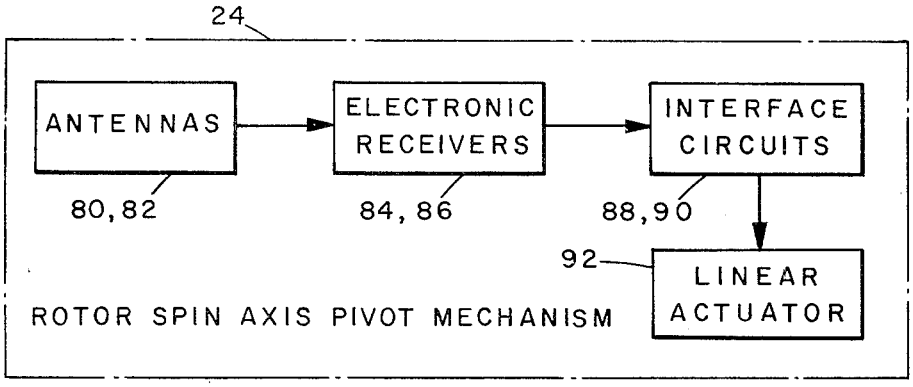
FIG. 10 is a block diagram of the electronic circuitry of the first embodiment of my steerable bullet.
Figure 11:
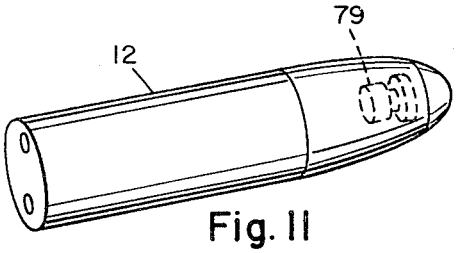
FIG. 11 is a simplified view of an embodiment of my steerable bullet which incorporates an on-board homing sensor in the form of a gimballed seeker head assembly.
Figure 12:
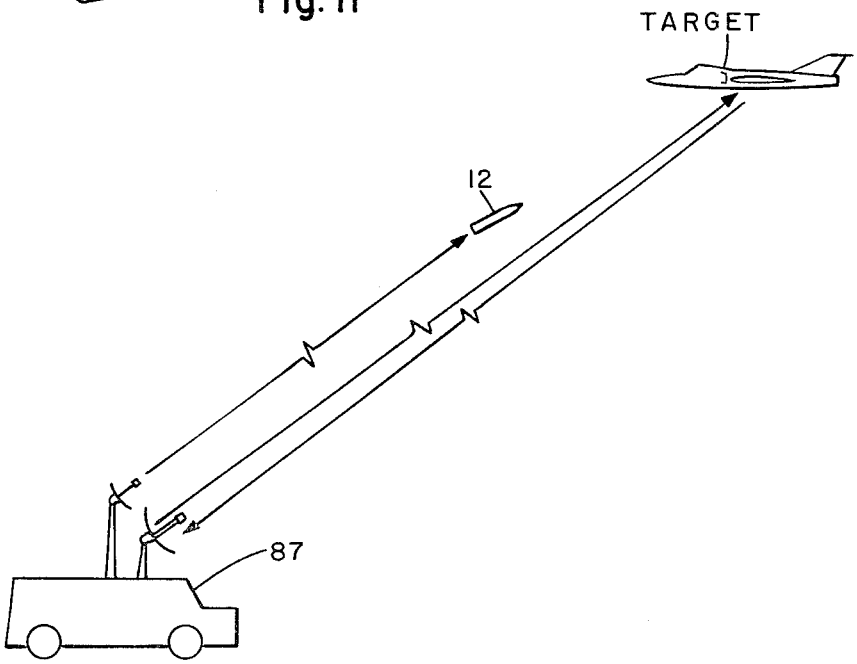
FIG. 12 illustrates a radar tracking installation which may transmit up-link data to another embodiment of my steerable bullet in order to guide the same to a target.

The steerable bullet 10 includes means for providing steering commands. The bullet may include an on-board homing sensor, for example a gimballed seeker head assembly 79 (FIG. 11). Due to the cost and complexity of the former, it may be preferable to utilize up-link data received from a remote error sensor, techniques for which are well known to those familiar with modern guided weapon systems. In the event that this latter approach is utilized, the bullet may include a pair of antennas 80 and 82 (FIGS. 1, 3 and 10) mounted in the end cap 16*b* of the projectile body. These antennas may comprise, for example, short dipoles, or quarter wave stubs. Alternatively, other antenna types such as microstrip antennas could be utilized. The antennas 80 and 82 are connected to electronic receivers 84 and 86, respectively for receiving up-link data signals from a remote error sensor device such as a radar tracking installation 87 (FIG. 12). The receivers 84 and 86 (FIGS. 3 and 10) are connected to on-board electronic interface circuits 88 and 90 which process the up-link data signals to derive rotationally phased steering commands therefrom which are applied to the rotor spin axis pivoting means hereafter described.

In the first embodiment 10 of my steerable bullet, the rotor spin axis pivoting means includes a linear actuator 92 (FIGS. 3, 4 and 10) and a linkage means 94 for operatively coupling the yoke 46 and the driven rod 96 of the actuator. The linkage means 94 includes a collar 98 which slides over the post 40, a first linkage arm 100 pivotally connected between the rear end of the yoke 46 and the collar, and a second pivot arm 102 pivotally connected between the collar and the rod 96 of the linear actuator. The second linkage arm 102 is pivotally connected intermediate its length to a fulcrum block 104 which is secured to the dividing member 56.

Figure 6:
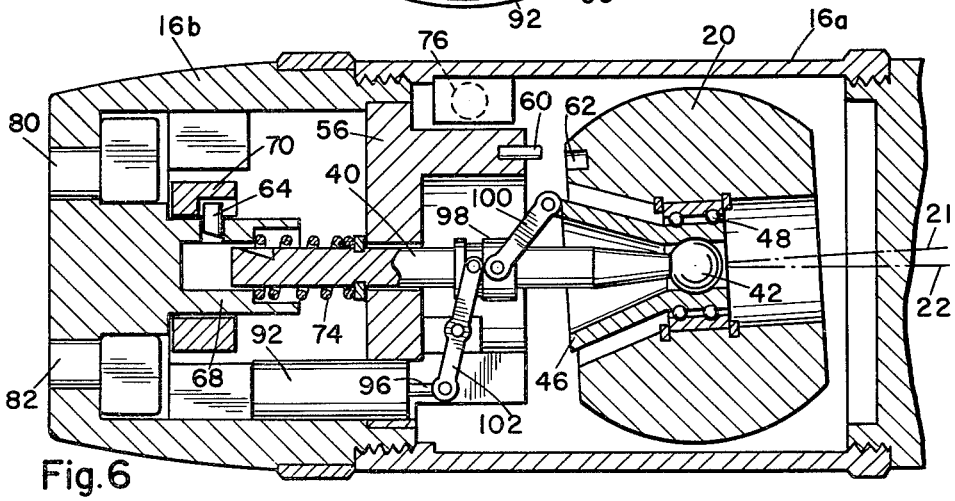
FIG. 6 is a sectional view similar to FIG. 4, showing the spin axis of the gyro rotor angularly offset from the projectile body axis in order to induce a perturbation of the projectile velocity vector.

The rod 96 of the linear actuator 92 (FIGS. 3 and 4) extends and retracts different degrees in response to steering commands which are applied to the actuator by the electronic interface circuits 88 and 90. These steering commands are sent after the rotor 20 has been unlocked and the projectile body has been de-spun relative to the rotor. Extension and retraction of the rod 96 of the linear actuator causes the spin axis 21 of the rotor to vary with respect to the projectile body axis 22 as shown in FIG. 6.

Having described the construction of the first embodiment 10 of my steerable bullet, its operation can now be described. The bullet is loaded into the breech of the firearm or artillery piece from which the bullet is to be fired. At this time, the post 40 is held in its retracted position illustrated in FIG. 3 by the pin 64 which is held inserted by the sleeve 70. The spring 74 surrounding the post is compressed between the stop 75 and the cylindrical portion 68 of the end cap 16*b*. With the post in its retracted position, the rotor 20 is locked to the raised portion 58 of the dividing member within the projectile body.

Once the bullet has been loaded and the breech of the firearm or artillery piece has been closed, the propulsive means of the bullet may be detonated to launch the bullet. During launch, the rifling bands 28 and 30 cooperate with the helical rifling on the inner surface of the barrel to impart a high rate of spin or rotation of the projectile body about its longitudinal axis. The acceleration at launch causes the sleeve 70 to slide rearwardly in FIG. 3, which in turn permits the pin 64 to disengage the rearward end of the gyro post 40. As soon as the bullet decelerates sufficiently, the compressed spring 74 expands, moving the post 40 to its extended position illustrated in FIG. 4. This moves the rotor 20 forwardly, clear of the pins 60, thus unlocking the rotor to permit free rotation thereof. The interface circuits 88 and 90 send signals to the linear actuator 92 for causing the linkage arms 100 and 102 to move from their positions shown in FIG. 3 to their positions shown in FIG. 4. This permits forward movement of the rotor 20 to a position clear of the pin 60 and with the spin axis 21 of the rotor coincident and in alignment with the rotational axis 22 of the projectile body. Both the projectile body and the rotor are rotating about the longitudinal axis of the projectile body at the same rate.

Next, the de-spin charge 76 (FIG. 4) may be ignited, for example by a timed signal generated by the on-board electronic circuitry. The exhaust gases from the de-spin charge 76 are vented externally of the projectile body through the exhaust port 78 (FIG. 5) substantially tangential to the surface axis of the rotor. The amount of thrust produced, and its duration, are sufficient to slow the rotation of the projectile body down to a fairly low rate, for example between zero and ten revolutions per second and increase the angular rotation rate of the rotor. However, because the rotor is free-spinning, it remains rotating at a very high rate relative to the projectile body. The de-spin thrust acts against the rotor to impart a transfer of angular momentum. The body slows down and the rotor speeds up.

At this point, the spin axis 21 of the rotor and the longitudinal axis 22 of the projectile body are still coincident. The projectile has a net spin stability which is determined by the ensemble of the spin moments of inertia of both the projectile body and the rotor. Thus, the gyro within the bullet provides some of the spin-stabilization formerly provided only by the projectile body spin.

Up link data signals from a remote error sensor, such as a radar equipped target tracking station 87 (FIG. 12), are transmitted to the bullet during flight. These up link data signals are received by the antennas 80 and 82 (FIG. 1) in the end cap 16*b* of the bullet. The on-board electronic interface circuits 84 and 86 connected to the antennas process the up link data signals to generate steering commands therefrom which are applied to the linear actuator 92. Since the projectile body is spinning, the phase of the steering commands must be varied through 360 degrees of rotation of the projectile body at the same known rate of rotation of the body.

The torque applied by the linear actuator 92 to the rotor support means through the linkage causes the spin axis 21 to pivot away from the rotational axis 22 of the projectile body as illustrated in FIG. 6. The resulting precession torque of the spinning rotor will induce a change in the angle of attack of the projectile body as illustrated in FIG. 2. Aerodynamic lift then imparts an acceleration normal to the actual velocity vector 105 of the projectile body. In effect, pivoting the spin axis of the rotor relative to the longitudinal axis of the projectile body causes a certain degree of pitch movement in the nose of the projectile body. When the control torque supplied by the linear actuator 92 is removed, the combination of the spring constant and viscous damping generated by elements within the linear actuator causes the spin axis of the rotor to once again align with the longitudinal axis of the projectile body once the desired velocity vector has been achieved. Thus, by adjusting the spin axis of the rotor during flight, midcourse trajectory shaping can be achieved to thereby insure that the bullet strikes the target.

Phasing of the steering command signals relative to the desired direction of velocity vector change is a function of the various physical parameters associated with the projectile. For example, precession torque generates a moment perpendicular to the applied torque, and the resultant pitch rate axis will lie between the two. The torque supplied by the linear actuator 92, the spring constant of that actuator, and the viscous damping force of the actuator are dependent in value upon physical parameters of the bullet. When the projectile body axis and the rotor spin axis are unaligned, as in FIG. 6, the spinning rotor will attempt to maintain its inertial position, thus imparting torque to the projectile body rotational axis. When this occurs, the projectile body senses imbalance in aerodynamic forces on its surface and attempts to correct for this by altering its velocity vector. Digital computer simulations of the trajectory of the bullet and of the stability of the system have been used to validate the feasibility of the invention.

Figure 7:
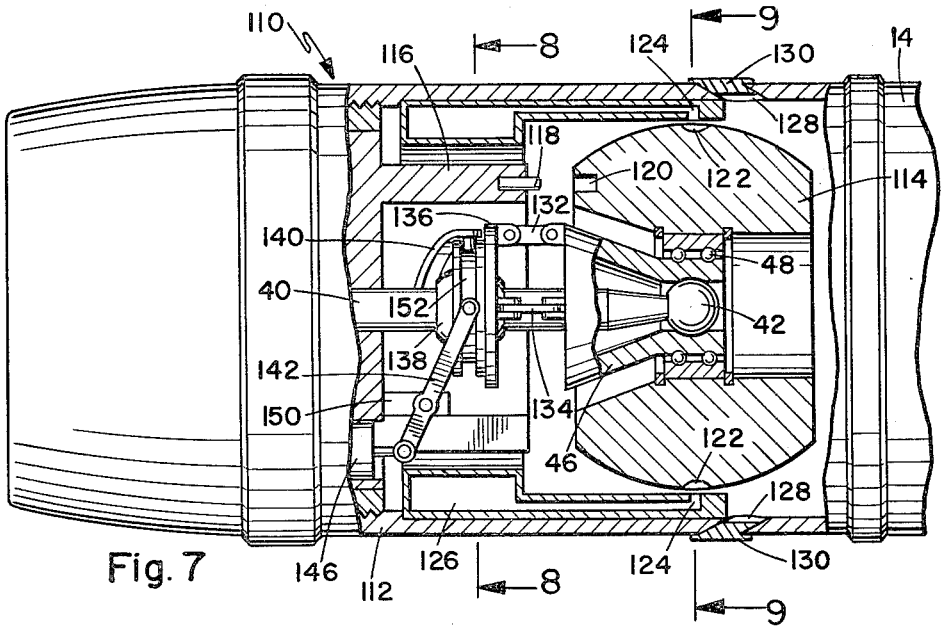
FIG. 7 is an enlarged side elevation view, with portions cut away, illustrating a second embodiment of my steerable bullet in which the gyro rotor is spun-up during flight by an internal jet. The spin axis of the rotor is thereafter pivoted in two orthogonal planes to effectuate midcourse trajectory shaping.
Figure 8:
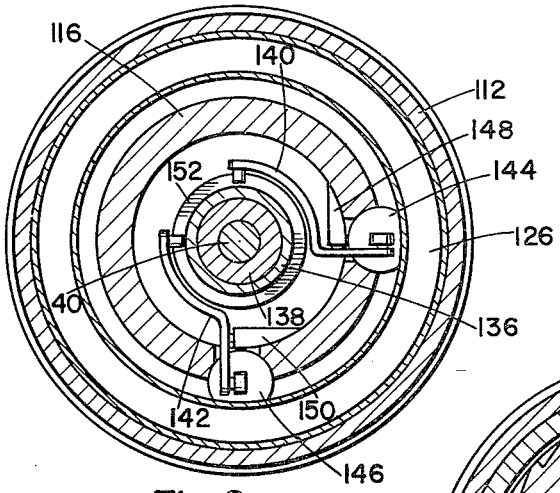
FIG. 8 is a sectional view taken along line 8—8 of FIG. 7 illustrating details of the rotor spin axis pivoting mechanism of the second embodiment of my steerable bullet.
Figure 9:
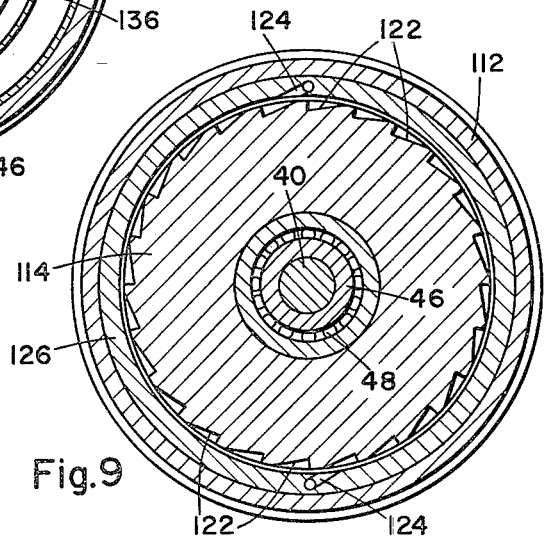
FIG. 9 is a sectional view taken along line 9—9 of FIG. 7 illustrating details of the mechanisms for spinning up the rotor of the second embodiment of my steerable bullet.

FIGS. 7-9 illustrate a second embodiment 110 of my gyroscopically steerable bullet. Parts of the second embodiment which are identical to those utilized in the first embodiment are indicated with like reference numerals. The projectile body 112 of the second embodiment is not spun-up during launch and therefore does not spin during flight. Accordingly, the rotor 114 must be spun-up by some means others than the transfer of angular momentum from the projectile body. Furthermore, means must be provided for pivoting the spin axis of the rotor in two orthogonal control planes whose intersection coincides with the longitudinal central axis of the projectile body. Thus, steering of the bullet may be accomplished by controlling the pitch and yaw of the projectile body during flight utilizing precession torque generated by pivoting the spin axis of the rotor.

The rotor 114 of my second embodiment is rotatably supported by the yoke 46 which is mounted for 360 degree pivotal movement on the ball 42 at the forward end of the post 40. The bearing assembly 48 provides the rotational mounting between the rotor 114 and the forward end of the yoke 46. Within the rearward portion of the projectile body 112 are locking means such as that utilized in the first embodiment. They hold the post 40 in a rearward position during launch in which the rotor 114 is held in locked relationship against the raised portion of a dividing member 116. In this locked position, pins 118 extend into recesses 120 in the rotor to lock the same in position and reduce the likelihood of damage to the delicate rotational support and pivoting mechanisms under the tremendously high accelerations encountered during launch. Once the projectile has been launched, the locking means at the rearward end of the post 40 releases the post, which then slides forwardly to its extended position illustrated in FIG. 7. This in turn moves the rotor 114 forwardly to permit the same to spin freely.

The outside circumference of the rotor 114 has a plurality of spaced apart notches or bucket shaped recesses 122 (FIGS. 7 and 9) which extend around the rotor intermediate its forward and rear ends. When the rotor 114 is moved to its free spinning position shown in FIG. 7, the notches 122 are aligned with a pair of circumferentially spaced nozzles 124 at the forward end of an internal manifold 126. This manifold surrounds the rotor 114 and the rotor spin axis pivoting means hereafter described. Shortly after launch, the on-board electronics in the steerable bullet 110 cause an internal gas generator (not shown) coupled to the manifold to begin to generate high pressure gas. This gas is expelled from the nozzles 124 against the notches formed in the circumference of the rotor 114. High speed rotation of the rotor is quickly achieved. As shown in FIG. 9, the nozzles 124 are preferably spaced approximated 180 degrees apart and expel gas tangentially against the outer circumference of the rotor into the notches or buckets 122. As an alternative to the manifold 126 and internal gas generator, a capsule having an outlet end positioned adjacent the notches 122 may be ignited shortly after launch so that high pressure gas expelled therefrom will spin-up the rotor 114.

One-way valve means are provided for preventing high pressure gases generated external of the projectile body 112 during launch from entering into the interior of the projectile body and damaging the components therein. The one-way valve means thereafter permit high pressure gases generated internal of the projectile for spinning up the rotor to be expelled from the projectile body. In the second embodiment 110, the one-way valve means takes the form of a pair of rearwardly extending exhaust vents 128 (FIG. 7) formed in the projectile body 112 adjacent the rotor 114. The exhaust vents are each initially sealed with plugs 130. When the second embodiment 110 of my steerable bullet is launched from a barrel, the high pressure gases generated externally of the projectile body cannot enter the interior of the projectile body because of the plugs. The caps on these plugs prevent them from being blown inwardly through the exhaust vents 128. Shortly after launch, the internal high pressure gases generated inside the projectile body are used to spin-up the rotor, and these gases blow the plugs 130 out of the exhaust vents 128. The exhaust vents are slanted backwards so that they do not function as ambient air-intakes during flight, which would otherwise inhibit the rapid expulsion of internal gases from the projectile body.

The yoke 46 (FIG. 7) is pivotally connected by a pair of linkage arms 132 and 134 to a swash plate 136. The swash plate 136 is mounted for 360 degree pivotal movement about a ball 138 slidably mounted on the post 40 (FIGS. 7 and 8). The linkage arms 132 and 134 are connected between the outer perimeters of the rounded rearward end of the yoke 46 and the round swash plate 136 at locations spaced apart by approximately ninety degrees. A second pair of ninety degree spaced conformably shaped linkage arms 140 and 142 (FIGS. 7 and 8) are pivotally connected between the swash plate 136 and the piston rods of a pair of linear actuators 144 and 146. The linkage arms 140 and 142 are pivotally connected, intermediate their lengths, to respective fulcrum members 148 and 150 (FIG. 8) which are mounted to the dividing member 116. The forward ends of the linkage arms 140 and 142 each have pins which are slidably received in an annular groove 152 formed in the external periphery of the swash plate 138. This permits these linkage arms to pivot and slide circumferentially with respect to the swash plate as it tilts about the ball 138.

It will be understood that the foregoing pivot mechanism permits the spin axis of the rotor 114 to be selectively and independently pivoted in two orthogonal control planes, away from the longitudinal central axis of the projectile body. This is accomplished by applying steering command signals generated by on-board electronic circuitry to the linear actuators 144 and 146.

Again, the steering commands may be generated by an on-board homing sensor and electronic guidance circuit. Alternatively, the steering commands may be generated from up-link data signals from a remote error sensor.

In the second embodiment 110 of my steerable bullet, the projectile body does not spin. Shortly after launch, the rotor is unlocked and spun-up by the jet mechanism with the spin axis of the rotor coincident and in alignment with the central longitudinal axis of the projectile body. Thus, the rotor initially provides the projectile body with spin stability to minimize deviations from its initial course. Thereafter, the spinning rotor is pivoted so that its spin axis is moved away from the longitudinal central axis of the projectile body, selectively and independently in the two orthogonal control planes. The resulting precession torques generate pitch and yaw movements of the projectile body during flight to accomplish the desired midcourse trajectory shaping to insure that the steerable bullet hits the target. In the second embodiment, the steering commands need not be phased to the rolling motion of the projectile body since the body is stationary and the spinning rotor is pivoted in two control planes.

Having described preferred embodiments of my gyroscopically steerable bullet, it should be apparent to those skilled in the art that my invention may be modified in arrangement and detail. For example, the first embodiment may require the internal jet, rotor notches, and one-way valve means to achieve sufficient transfer of angular momentum. Therefore, the protection afforded my invention should be limited only in accordance with the scope of the following claims.

I claim:

1. A steerable bullet comprising:

a projectile body having a longitudinal axis;

a gyro mounted within the projectile body including a rotor and means for supporting the rotor for rotation about a spin axis initially coincident with the projectile axis and pivotable away from the projectile axis;

means for spinning the rotor;

means for providing steering commands; and means responsive to the steering commands for pivoting the spin axis of the rotor relative to the projectile axis during aerial flight of the projectile body so that the resulting precession torque of the spinning rotor will induce a change in the angle of attack between the projectile axis and the actual velocity vector of the projectile body whereby midcourse trajectory shaping will be achieved.

2. A steerable bullet according to claim 1 wherein the supporting means of the gyro includes:

a post;

a tiltable yoke mounted on one end of the post and extending through a hole extending centrally through the rotor;

a bearing assembly rotatably mounting the rotor to the yoke.

3. A steerable bullet according to claim 2 wherein the pivoting means includes;

a linear actuator responsive to the steering commands; and linkage means for operatively coupling the yoke and the linear actuator.

4. A steerable bullet according to claim 1 wherein the means for spinning the rotor comprises means for transferring angular momentum from the projectile body to the rotor.

5. A steerable bullet according to claim 4 wherein the transferring means includes:

means for locking the rotor to the projectile body with the spin axis and the projectile axis substantially coincident so that the rotor will be spun when the projectile body is spun about its axis during launch;

means for unlocking the rotor after the projectile body and rotor have been spun during launch so that the rotor can spin freely; and means for de-spinning the projectile body relative to the rotor.

6. A steerable bullet according to claim 5 wherein the de-spinning means comprises a jet mounted in the projectile body for generating a thrust for transferring angular momentum to the rotor.

7. A steerable bullet according to claim 1 wherein the means for providing steering commands includes:

an on-board homing sensor.

8. A steerable bullet according to claim 1 wherein the means for providing steering commands includes:

an antenna mounted at the rear of the projectile body for receiving up-link data signals from a remote error sensor; and on-board electronic interface circuit means connected to the antenna for processing the up-link data signals to generate steering commands therefrom and for applying the steering commands to the rotor spin axis pivoting means.

9. A steerable bullet according to claim 2 wherein the rotor spin axis pivoting means includes a spring and damper combination for allowing the spin axis and projectile axis to realign once the desired velocity vector for the projectile body determined by the steering command has been achieved.

10. A steerable bullet according to claim 1 wherein the rotor spin axis pivoting means includes means for selectively and independently pivoting the spin axis in two orthogonal control planes whose intersection coincides with the projectile axis.

11. A steerable bullet according to claim 1 wherein the means for spinning the rotor comprises:

a plurality of notches spaced circumferentially about the rotor to define a turbine; and means for discharging a stream of pressurized gas against the notches.

* * * * *